US010961897B2

(12) United States Patent
Lee et al.

(10) Patent No.: US 10,961,897 B2
(45) Date of Patent: Mar. 30, 2021

(54) METHODS OF CONTROLLING ELECTRICAL COOLANT VALVE FOR INTERNAL COMBUSTION ENGINE

(71) Applicants: Hyundai Motor Company, Seoul (KR); Kia Motors Corporation, Seoul (KR)

(72) Inventors: Jason Hoon Lee, Ann Arbor, MI (US); Sejun Kim, Seoul (KR); Byungho Lee, Ann Arbor, MI (US); Sanghoon Yoo, Ypsilanti, MI (US); Kwangwoo Jeong, Ann Arbor, MI (US)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/290,134

(22) Filed: Mar. 1, 2019

(65) Prior Publication Data

US 2020/0277888 A1 Sep. 3, 2020

(51) Int. Cl.
*F01P 11/16* (2006.01)
*F01P 7/16* (2006.01)
*F01P 7/14* (2006.01)

(52) U.S. Cl.
CPC ..... *F01P 7/16* (2013.01); *F01P 2007/146* (2013.01); *F01P 2025/30* (2013.01); *F01P 2025/32* (2013.01); *F01P 2025/50* (2013.01); *F01P 2025/60* (2013.01)

(58) Field of Classification Search
CPC combination set(s) only.
See application file for complete search history.

(56) References Cited

U.S. PATENT DOCUMENTS 4,930,455 A 6/1990 Creed et al.
4,989,573 A * 2/1991 Yokoyama ..... F02B 43/00 123/179.21
5,157,956 A * 10/1992 Isaji ..... B60K 28/16 73/1.75
5,531,264 A * 7/1996 Eike ..... B60H 1/00014 165/42
6,101,987 A * 8/2000 Saur ..... F01P 7/048 123/41.1
6,178,928 B1 1/2001 Corriveau
2010/0175401 A1* 7/2010 Taguchi ..... F04B 27/1804 62/228.3

(Continued)

FOREIGN PATENT DOCUMENTS

JP 3435554 B2 8/2003

*Primary Examiner* — George C Jin
*Assistant Examiner* — Teuta B Holbrook
(74) *Attorney, Agent, or Firm* — Mintz Levin Cohn Ferris Glovsky and Popeo, P.C.; Peter F. Corless

(57) ABSTRACT

A method can include: acquiring, via one or more sensors disposed in a vehicle, one or more engine operation parameters relating to operation of an internal combustion engine disposed along a coolant flow path in the vehicle; calculating at least one target coolant temperature according to the one or more engine operation parameters; and controlling a valve actuator to regulate flow of a coolant through the coolant flow path via an electric coolant valve operatively coupled to the valve actuator such that a temperature of the coolant changes in accordance with the at least one target coolant temperature.

19 Claims, 2 Drawing Sheets

(56) References Cited

U.S. PATENT DOCUMENTS

| | | | | |
|---|---|---|---|---|
| 2013/0325268 | A1* | 12/2013 | Ishihara | E02F 9/2246 701/50 |
| 2015/0176538 | A1* | 6/2015 | Baasch | F02M 26/26 123/568.12 |
| 2016/0376978 | A1* | 12/2016 | Gonze | F01P 7/167 123/41.1 |
| 2017/0022881 | A1* | 1/2017 | Matsumoto | F01P 7/16 |
| 2017/0058743 | A1* | 3/2017 | Lee | B01D 53/9418 |
| 2017/0074153 | A1 | 3/2017 | Kaneko et al. | |
| 2017/0074154 | A1* | 3/2017 | Kaneko | F01P 11/18 |
| 2018/0135502 | A1* | 5/2018 | Nakanishi | F01P 7/16 |
| 2018/0183078 | A1* | 6/2018 | Yamada | H01M 8/0435 |
| 2018/0346100 | A1* | 12/2018 | Veilleux, Jr. | F02C 7/27 |
| 2018/0354776 | A1* | 12/2018 | Lee | B01D 35/005 |
| 2018/0355765 | A1* | 12/2018 | Patel | F01K 23/10 |

* cited by examiner

METHODS OF CONTROLLING ELECTRICAL COOLANT VALVE FOR INTERNAL COMBUSTION ENGINE

TECHNICAL FIELD

The present disclosure relates generally to automotive thermal management systems, and more particularly, to methods of controlling an electric coolant valve for an internal combustion engine of a vehicle.

BACKGROUND

Many modern vehicles are equipped with a thermal management system (TMS) or a thermal management module (TMM) for controlling the operating temperature of an internal combustion engine as well as ancillary systems (e.g., engine oil heat exchanger, heater core, radiator, etc.). A TMM generally utilizes electronically controllable actuators in place of a conventional mechanical thermostat, which is limited to a fixed operating temperature, to regulate the flow of coolant and other fluids and thereby improve engine temperature tracking over most operating ranges. By actively controlling the engine operating temperature, the TMM can enable the ideal operating temperature to be reached in the shortest possible time. Various benefits can be achieved as a result, such as enhanced fuel economy, accelerated engine and cabin warm-up, and reduced carbon dioxide emissions.

The TMM often uses an electric coolant valve to modulate coolant flow through the vehicle's engine cooling circuit. In some cases, coolant flow modulation can be achieved by controlling a position of the electric coolant valve via an electric motor attached to the valve. When controlled efficiently, the electric coolant valve can manage the temperature balance inside the drivetrain in a manner which allows the engine and transmission to reach an optimum temperature quickly.

SUMMARY

The present disclosure provides methods of controlling an electric coolant valve for an internal combustion engine to dynamically control coolant temperature such that the temperature tracks a changing target temperature calculated based upon one or more engine operation parameters, such as engine torque, engine speed, or the like. The present disclosure further provides control logic for controlling a position of the electric coolant valve to regulate the amount of coolant flow through the internal combustion engine, as well as ancillary systems such as the radiator, heat exchanger units, heater core, and so forth, in accordance with a target temperature calculated in real-time.

According to embodiments of the present disclosure, a method can include: acquiring, via one or more sensors disposed in a vehicle, one or more engine operation parameters relating to operation of an internal combustion engine disposed along a coolant flow path in the vehicle; calculating at least one target coolant temperature according to the one or more engine operation parameters; and controlling a valve actuator to regulate flow of a coolant through the coolant flow path via an electric coolant valve operatively coupled to the valve actuator such that a temperature of the coolant changes in accordance with the at least one target coolant temperature.

The controlling of the valve actuator can include controlling the valve actuator to regulate flow of the coolant through the coolant flow path via the electric coolant valve such that a temperature of the coolant located at or proximate to an outlet of the internal combustion engine changes in accordance with the at least one target coolant temperature.

The method can further include: calculating a valve angular position based on the at least one target coolant temperature; and controlling the valve actuator to adjust an angular position of the electric coolant valve in accordance with the valve angular position. In addition, the method can include: generating a driving signal based on the valve angular position using a pulse-width (PW) modulator; and transmitting the driving signal to the valve actuator so as to cause the valve actuator to adjust the angular position of the electric coolant valve in accordance with the valve angular position.

The method can further include: acquiring an engine speed of the internal combustion engine using an engine speed sensor; acquiring an engine torque of the internal combustion engine using an engine torque sensor; and calculating the at least one target coolant temperature according to the engine speed and the engine torque. In addition, the method can include: determining the at least one target coolant temperature using a pre-generated target temperature map configured to output the at least one target coolant temperature based on the engine speed and the engine torque.

The calculating of the at least one target coolant temperature can include calculating the at least one target coolant temperature for each time step of a plurality of time steps.

The method can further include: calculating an target engine outlet coolant temperature corresponding to a temperature of the coolant located at or proximate to an outlet of the internal combustion engine according to the one or more engine operation parameters; calculating an target engine inlet coolant temperature corresponding to a temperature of the coolant located at or proximate to an inlet of the internal combustion engine based on the target engine outlet coolant temperature; and controlling the valve actuator to regulate flow of the coolant through the coolant flow path via the electric coolant valve such that the temperature of the coolant located at the inlet of the internal combustion engine changes in accordance with the target engine inlet coolant temperature. The temperature of the coolant located at or proximate to the outlet of the internal combustion engine can change based on the temperature of the coolant located at the inlet of the internal combustion engine.

The calculating of the target engine inlet coolant temperature can include: acquiring an engine speed of the internal combustion engine using an engine speed sensor; acquiring an engine torque of the internal combustion engine using an engine torque sensor; and calculating the target engine inlet coolant temperature according to the engine speed and the engine torque. In addition, the calculating of the target engine inlet coolant temperature can include calculating the target engine inlet coolant temperature based on the target engine outlet coolant temperature, a current temperature of the coolant located at or proximate to the outlet of the internal combustion engine, and a current temperature of the coolant located at or proximate to the inlet of the internal combustion engine.

The method can further include: acquiring the current temperature of the coolant located at or proximate to the outlet of the internal combustion engine using an engine outlet temperature sensor disposed at or proximate to the outlet of the internal combustion engine; and acquiring the current temperature of the coolant located at or proximate to the inlet of the internal combustion engine using an engine inlet temperature sensor disposed at or proximate to the inlet of the internal combustion engine.

Moreover, the method can further include: acquiring the current temperature of the coolant located at or proximate to the outlet of the internal combustion engine using an engine outlet temperature sensor disposed at or proximate to the outlet of the internal combustion engine; and estimating the current temperature of the coolant located at or proximate to the inlet of the internal combustion engine using a predetermined model based on the current temperature of the coolant located at or proximate to the outlet of the internal combustion engine.

The calculating of the target engine inlet coolant temperature can further include calculating the target engine inlet coolant temperature based further on a difference between the current temperature of the coolant located at or proximate to the outlet of the internal combustion engine and the current temperature of the coolant located at or proximate to the inlet of the internal combustion engine.

The method can further include: calculating a valve angular position based on the target engine outlet coolant temperature and the target engine inlet coolant temperature; and controlling the valve actuator to adjust an angular position of the electric coolant valve in accordance with the valve angular position. In this regard, the calculating of the valve angular position can include calculating the valve angular position based on the target engine outlet coolant temperature, the target engine inlet coolant temperature, a current temperature of the coolant located at or proximate to the outlet of the internal combustion engine, and a current temperature of the coolant located at or proximate to the inlet of the internal combustion engine. Also, the calculating of the valve angular position can include calculating the valve angular position for each time step of a plurality of time steps.

The method can further include: calculating a change in valve angular position based on the at least one target coolant temperature; calculating a desired valve angular position based on the change in valve angular position and a current valve angular position; and controlling the valve actuator to adjust an angular position of the electric coolant valve in accordance with the desired valve angular position. In addition, the calculating of the change in the valve angular position can include calculating the change in the valve angular position based on the at least one target coolant temperature and an angular speed of the electric coolant valve.

The valve actuator can include a rotary motor configured to adjust an angular position of an opening of the electric coolant valve.

The method can further include: applying a correction value to the at least one target coolant temperature based on an accumulated cooling demand; and controlling the valve actuator to regulate flow of the coolant through the coolant flow path via an electric coolant valve operatively coupled to the valve actuator such that the temperature of the coolant changes in accordance with the at least one target coolant temperature having the correction value applied thereto.

BRIEF DESCRIPTION OF THE DRAWINGS

The embodiments herein may be better understood by referring to the following description in conjunction with the accompanying drawings in which like reference numerals indicate identically or functionally similar elements, of which.

Figure 1:
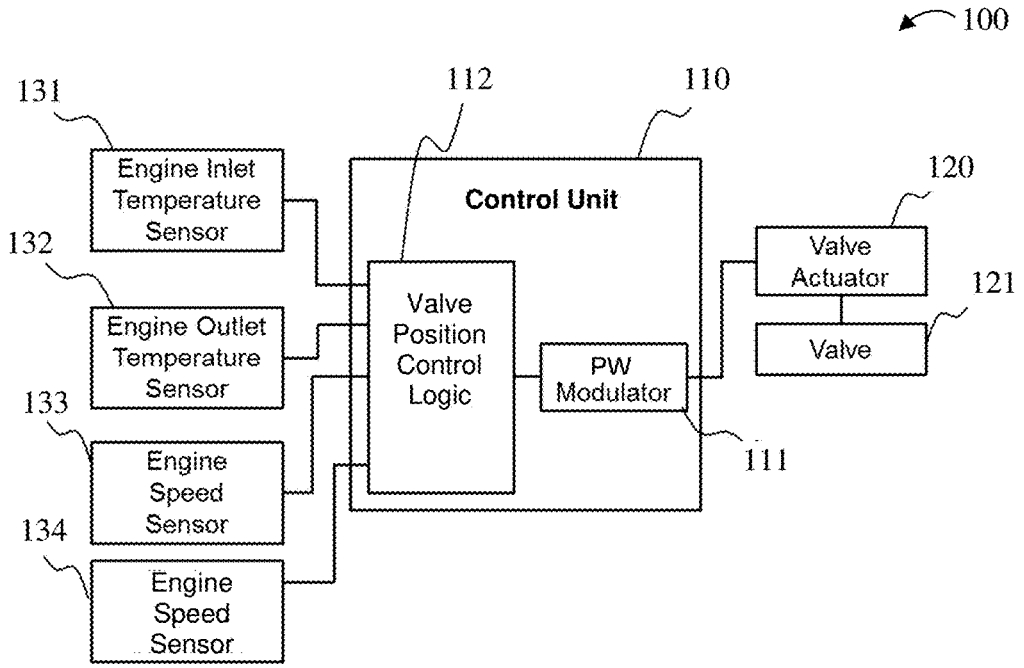
FIG. 1 is a schematic view of an exemplary electric coolant valve control architecture.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Additionally, it is understood that one or more of the below methods, or aspects thereof, may be executed by at least one control unit, or electronic control unit (ECU). The term "control unit" may refer to a hardware device that includes a memory and a processor. The memory is configured to store program instructions, and the processor is specifically programmed to execute the program instructions to perform one or more processes which are described further below. The control unit may control operation of units, modules, parts, devices, or the like, as described herein. Moreover, it is understood that the below methods may be executed by an apparatus comprising the control unit in conjunction with one or more other components, as would be appreciated by a person of ordinary skill in the art.

Furthermore, the control unit of the present disclosure may be embodied as non-transitory computer readable media containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed throughout a computer network so that the program instructions are stored and executed in a distributed fashion, e.g., by a telematics server or a Controller Area Network (CAN).

Referring now to embodiments of the present disclosure, the disclosed methods of controlling an electric coolant valve for an internal combustion engine can involve calculating one or more target coolant temperatures based upon one or more dynamically changing engine operation parameters, such as engine torque, engine speed, or the like, and controlling, in real-time, flow of coolant through the engine cooling circuit via an electric coolant valve. The electric coolant valve can be controlled in such a manner that the temperature of the coolant tracks one of the one or more calculated target coolant temperatures. This can allow for accurate and responsive control by the engine TMM, producing improvements in a variety of performance metrics such as fuel economy, emissions, and heating/cooling performance.

FIG. 1 is a schematic view of an exemplary electric coolant valve control architecture. As shown in FIG. 1, the electric coolant valve control architecture 100 can include, at least, a control unit (e.g., ECU) 110 and a valve actuator 120 operatively coupled to an electric coolant valve 121. The control unit 110 can be configured to control operation of various components of the vehicle including the valve actuator 120. The control unit 110 can refer to a hardware device that includes a memory and a processor, as noted above. The memory of the control unit 110 can store program instructions for execution of various processes by the processor. For instance, the memory can store program instructions for executing the valve position control logic 112, as described in detail herein.

The control unit 110 can further include a pulse-width (PW) modulator 111 configured to generate a signal through modulation of output data produced by the valve position control logic 112. Thus, the PW modulator 111 can be operatively coupled to the valve position control logic 112 so as to receive data output from the valve position control logic 112. For instance, the control unit 110 can calculate a valve angular position with which to control the electric coolant valve 121, as described in greater detail below, using the valve position control logic 112. The PW modulator 111 can receive the calculated valve angular position from the valve position control logic 112, and use the calculated valve angular position to generate a driving signal for electronically controlling the valve actuator 120, in order to adjust the angular position of the electric coolant valve 121 in accordance with the calculated valve angular position.

Figure 2:
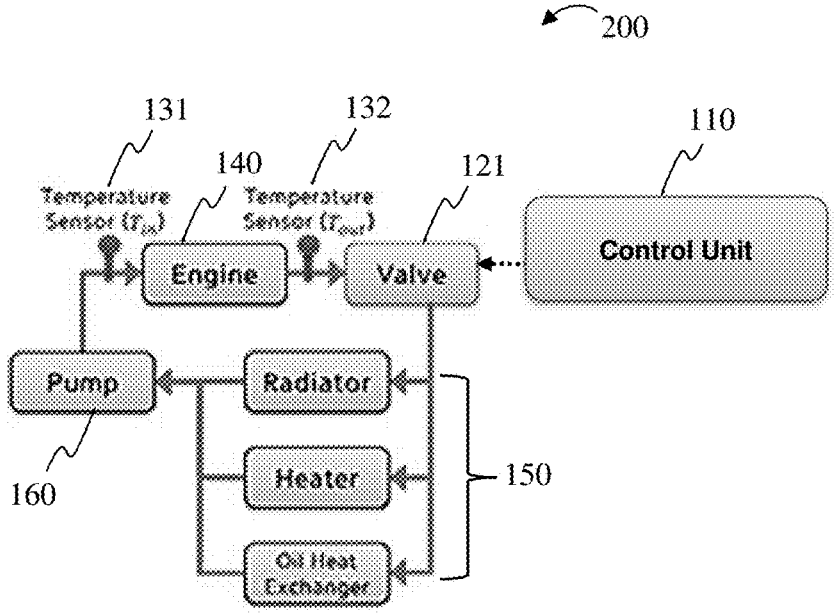
FIG. 2 is a schematic view of an exemplary engine cooling circuit.

The control unit 110 can be operatively coupled to a plurality of sensors equipped in the vehicle (not shown), and can acquire various measurement data therefrom. Specifically, the control unit 110 can be operatively coupled to one or more of a plurality of coolant temperature sensors (e.g., engine water jacket temperature sensors), including, for example, an engine inlet temperature sensor 131 disposed at or proximate to an inlet of the internal combustion engine 140 (alternatively referred to herein as "engine") and an engine outlet temperature sensor 132 disposed at or proximate to an outlet of the engine 140, as illustrated in FIG. 2. The engine inlet temperature sensor 131 can be configured to measure the current temperature of the coolant flowing through the engine cooling circuit 200 located at or proximate to the inlet of the engine 140, and the engine outlet temperature sensor 132 can be configured to measure the current temperature of the coolant flowing through the engine cooling circuit 200 located at or proximate to the outlet of the engine 140. The current engine inlet coolant temperature and the current engine outlet coolant temperature can be transmitted to the control unit 110, and the valve position control logic 112 can utilize these measurement values for the purpose of calculating at least one target coolant temperature which can be used to control operation of the electric coolant valve 121.

During operation of the vehicle, it is understood that the temperature of coolant in the engine cooling circuit 200 can change dynamically. Thus, the engine inlet temperature sensor 131 and the engine outlet temperature sensor 132 can transmit the current engine inlet coolant temperature and the current engine outlet coolant temperature, respectively, to the control unit 110 on a continuous basis. The control unit 110, applying the valve position control logic 112, can then calculate at least one target coolant temperature, used for controlling operation of the electric coolant valve 121, based on the current engine inlet and outlet coolant temperatures, in real-time so as to quickly achieve an optimum engine temperature across all operating conditions.

In some embodiments, the electric coolant valve control architecture 100 can be implemented the engine inlet temperature sensor 131, such that only a single temperature sensor is disposed at or proximate to the outlet of the engine 140 (i.e., engine outlet temperature sensor 132). In such case, a pre-generated dynamic model can be utilized to estimate the engine inlet coolant temperature. For the purpose of demonstration, however, embodiments in which both the engine inlet temperature sensor 131 and the engine outlet temperature sensor 132 exist in the electric coolant valve control architecture 100 are primarily described below.

The control unit 110 can also be operatively coupled to one or more of a plurality of engine operation sensors, including, for example, an engine speed sensor 133 and an engine torque sensor 134, which can collect measurements, i.e., one or more engine operation parameters, relating to operation of the engine 140. The engine speed sensor 133 can be coupled to the engine 140 to detect the speed of the engine 140 via techniques known in the art, such as measuring the speed at which a crankshaft of the engine 140 spins. Similarly, the engine torque sensor (or calculator) 134 can be coupled to the engine 140 to measure the torque of the engine via techniques known in the art (e.g., an engine dynamometer or "dyno"), or can calculate the engine torque based on particular variables such as engine revolutions per minute (RPMs). The engine speed and the engine torque can be transmitted to the control unit 110, and the valve position control logic 112 can utilize these measurement values for the purpose of calculating at least one target coolant temperature which can be used to control operation of the electric coolant valve 121. The control unit 110 can also be operatively coupled to additional engine operation sensors not described herein, and can receive engine operation parameters therefrom.

Similar to the engine inlet and outlet coolant temperatures described above, it is understood that the engine speed, engine torque, and other related engine operating parameters can change dynamically during operation of the vehicle. Thus, the engine speed sensor 133 and the engine torque sensor 134 can transmit the current engine speed and the current engine torque, respectively, to the control unit 110 on a continuous basis. The control unit 110, applying the valve position control logic 112, can then calculate the at least one target coolant temperature, based on the current engine speed and torque (as well as the current engine inlet and outlet coolant temperatures), used for controlling operation of the electric coolant valve 121, in real-time so as to quickly achieve the optimum engine temperature across all operating conditions.

Upon acquiring the aforementioned engine operation parameters, the control unit 110, applying the valve position control logic 112, can calculate the at least one target coolant temperature. The process for calculating the at least one target coolant temperature is described in detail with reference to FIG. 3 below.

Based on the at least one target coolant temperature, the valve position control logic 112 can calculate a valve angular position. The PW modulator 111 can use the calculated valve angular position, as briefly explained above, to generate a driving signal for electronically controlling the valve actuator 120. The control unit 110, via the PW modulator 111, can transmit the driving signal to the valve actuator 120, causing the valve actuator 120 to set the angular position of the electric coolant valve 121 in accordance with the valve angular position.

The valve actuator 120 can be an electric device operable to change the position (e.g., angular position) of the electric coolant valve 121. More specifically, the valve actuator 120 can be operable to change the position of an opening of the electric coolant valve 121, thereby regulating the amount of coolant flow to the engine 140 and ancillary components 150 disposed along the coolant flow path of the engine coolant circuit 200 shown in FIG. 2.

In some embodiments, the valve actuator 120 can include a rotary motor (e.g., servo motor) configured to adjust an angular position of the opening of the electric coolant valve 121. The electric coolant valve 121 can be an electronically controlled rotary valve, e.g., a rotary slide valve, that can rotatably adjust its opening regulate the flow of coolant therethrough, although the electric coolant valve 121 is not limited thereto. The valve actuator 120 can adjust the opening of the electric coolant valve 121 to affect the temperature of the engine 140.

FIG. 2 is a schematic view of an exemplary engine cooling circuit. As shown in FIG. 2, the engine cooling circuit 200 can include the electric coolant valve 121 through which coolant flows to the engine 140 via a coolant or water pump 160. The engine cooling circuit 200 can further include one or more ancillary components 150 including, for example, a radiator, a heater core, one or more heat exchangers (e.g., an oil cooler, an automatic transmission fluid (ATF) warmer, etc.), and so forth. Thus, the coolant flowing through the electric coolant valve 121 can flow through one or more of the ancillary components 150.

The ancillary components 150 can be disposed at various locations along the coolant flow path. In some embodiments, the ancillary components 150 can be disposed downstream of the electric coolant valve 121 and upstream of the engine 140, such that coolant flowing through the electric coolant valve 121 passes through the ancillary components 150 prior to reaching the engine 140. In other embodiments, one or more of the ancillary components can be disposed downstream of the electric coolant valve 121 and the engine 140, such that coolant flowing through the electric coolant valve 121 passes through the engine 140 prior to reaching said one or more ancillary components.

As further shown in FIG. 2, the engine inlet temperature sensor 131 can be disposed at or proximate to the inlet of the engine 140. The engine inlet temperature sensor 131 can measure the current temperature of the coolant before it passes through the engine 140. Meanwhile, the engine outlet temperature sensor 132 can be disposed at or proximate to the outlet of the engine 140. The engine outlet temperature sensor 132 can measure the current temperature of the coolant after it passes through the engine 140.

The control unit 110, as described above, can be operatively coupled to the electric coolant valve 121 (via the valve actuator 120, which is not shown in FIG. 2). Thus, the control unit 110 can transmit driving or control signals (designated by a dashed arrow in FIG. 2) for controlling operation of the electric coolant valve 121, thereby regulating flow of the coolant through the engine cooling circuit 200 so as to control the engine temperature in accordance with a calculated target coolant temperature, as described below.

Figure 3:
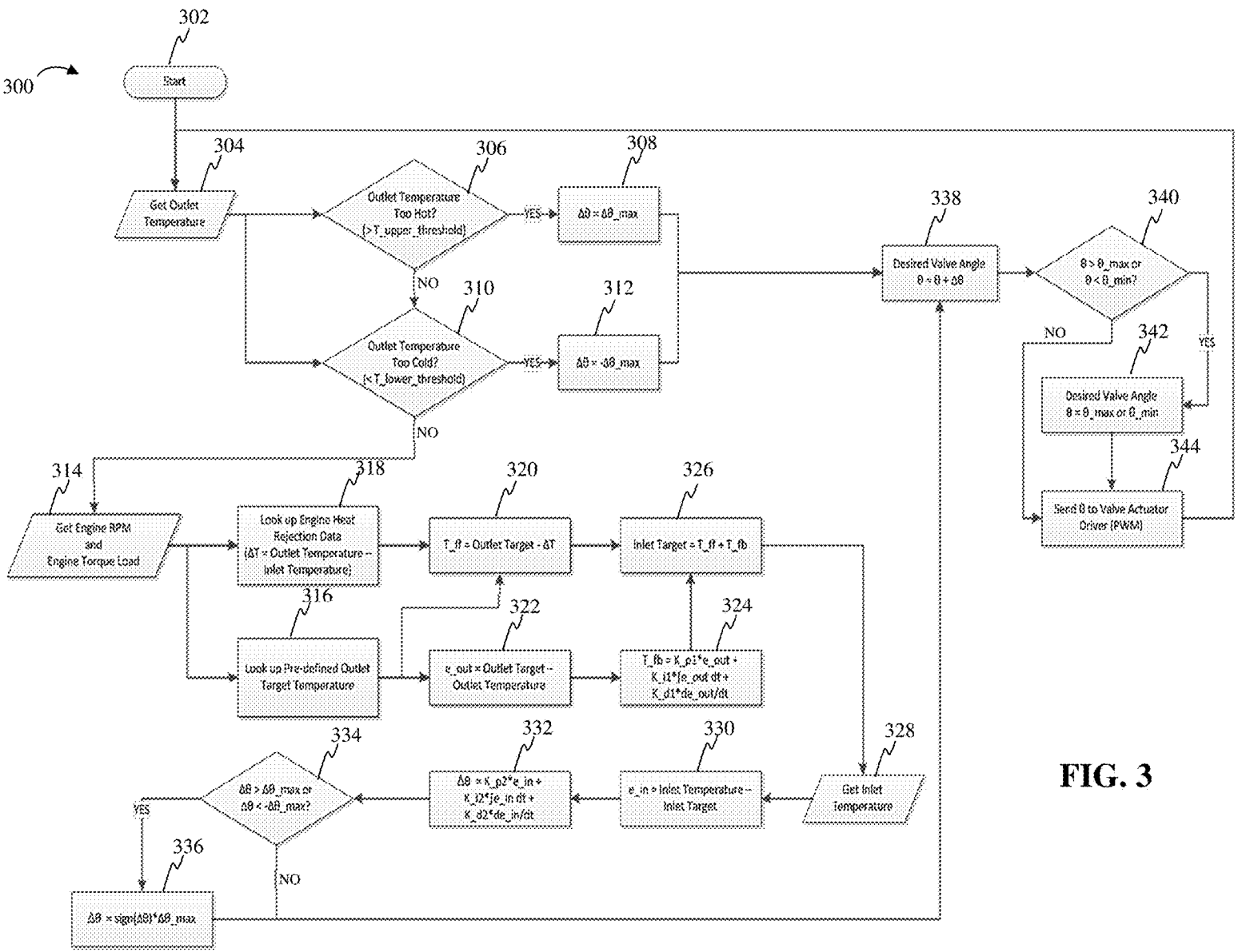
FIG. 3 is a flowchart illustrating an exemplary, simplified implementation of the control logic for performing electric coolant valve control.

FIG. 3 is a flowchart illustrating an exemplary, simplified implementation of the control logic for performing electric coolant valve control (i.e., valve position control logic 112). The procedure 300 can start at step 302, and continue to step 304, where, as described in greater detail herein, a temperature of the coolant flowing through the engine cooling circuit 200 can be controlled to track a given target temperature. In some embodiments, the coolant flowing through the electric coolant valve 121 can be controlled such that a temperature of the coolant located at or proximate to an outlet of the engine 140 (i.e., engine outlet coolant temperature) tracks the given target temperature, which can vary based upon the specific range in which the engine 140 is operating as determined by engine operation parameters (e.g., engine speed, engine torque, etc.) detected by sensors disposed in the vehicle.

At step 304, the control unit 110 can obtain the current engine outlet coolant temperature ($T_{out}$) corresponding to a temperature of the coolant located at or proximate to the outlet of the engine 140. As explained above, the control unit 110 can be operatively coupled to an engine outlet temperature sensor 132 disposed at or proximate to an outlet of the engine 140. The engine outlet temperature sensor 132 can send an indication of the temperature of the coolant at or proximate to the outlet of the engine 140 at the current time step (k) to the control unit 110.

At step 306, the control unit 110 can determine whether the current engine outlet coolant temperature ($T_{out}$) acquired in step 304 is too hot, or in other words, whether the current engine outlet coolant temperature ($T_{out}$) exceeds a predetermined upper threshold temperature ($T_{upper_threshold}$). If the engine outlet coolant temperature ($T_{out}$) exceeds the predetermined upper threshold temperature ($T_{upper_threshold}$), the procedure 300 can continue to step 308, where the control unit 110 can set the change in electric coolant valve angular position ($\Delta\theta$) to the maximum possible change in electric coolant valve angular position ($\Delta\theta_{max}$).

Conversely, if the control unit 110 determines that the current engine outlet coolant temperature ($T_{out}$) is not too hot, or is less than or equal to the predetermined upper threshold temperature ($T_{upper_threshold}$), the procedure 300 can continue to step 310, where the control unit 110 can determine whether the current engine outlet coolant temperature ($T_{out}$) is too cold, or in other words, whether the current engine outlet coolant temperature ($T_{out}$) is less than a predetermined lower threshold temperature ($T_{lower_threshold}$). If the engine outlet coolant temperature ($T_{out}$) is less than the predetermined lower threshold temperature ($T_{lower_threshold}$), the procedure 300 can continue to step 312, where the control unit 110 can set the change in electric coolant valve angular position ($\Delta\theta$) to the negative value of the maximum possible change in electric coolant valve angular position ($-\Delta\theta_{max}$).

After steps 308 or 312, the procedure 300 can continue to step 338, described in detail below. However, after steps 306 and 310, if the control unit 110 determines that the current engine outlet coolant temperature ($T_{out}$) is less than or equal to the predetermined upper threshold temperature ($T_{upper_threshold}$) and greater than or equal to the predetermined lower threshold temperature ($T_{lower_threshold}$), the procedure 300 can continue to step 314.

At step 314, the control unit 110 can acquire one or more engine operation parameters relating to operation of the engine 140. The one or more engine operation parameters can include, for example, an engine speed and an engine torque, though the engine operation parameters acquired by the control unit 110 are not limited thereto. As explained above, the control unit 110 can acquire the engine speed and the engine torque from the engine speed sensor 133 and the engine torque sensor 134, respectively. Using these parameters, the control unit 110 can detect the current operation condition of the engine 140, such as, for instance, low torque load/speed, high torque load/speed, presence of engine knocking, and so forth.

At step 316, the control unit 110 can calculate the target engine outlet coolant temperature ($T_{out_target}$) based on the one or more engine operation parameters acquired in step 314. The target engine outlet coolant temperature ($T_{out_target}$) can be derived in a variety of ways. In some embodiments, a target temperature map can be pre-generated and used to determine the target coolant temperature based upon engine operation parameters such as engine speed and torque. The target temperature map can be generated through physical testing or analysis using one or more sensors, such as an engine dynamometer to measure engine torque and an engine speed sensor to measure engine speed. In some instances, the testing can produce a two-dimensional map depending upon engine speed and engine torque to determine an optimal target coolant temperature. That is, the target temperature map can accept the engine speed and engine torque acquired in step 314 as inputs, and produce an optimum target engine outlet coolant temperature ($T_{out_target}$) as output.

Because the engine operation parameters (e.g., engine speed, engine torque, etc.) can change continuously during operation of the vehicle, the target engine outlet coolant temperature ($T_{out_target}$) can be repeatedly calculated for each time step (k). In order to prevent the target engine outlet coolant temperature ($T_{out_target}$) from changing too frequently, resulting in excessive valve position adjustments, a correction value can be applied to the target engine outlet coolant temperature ($T_{out_target}$) determination of step 316. The correction logic can be based on an "accumulated cooling demand" ($T_{accum}$) which updates the target engine outlet coolant temperature ($T_{out_target}$) when there is a certain amount of accumulated target shift request. A mathematical representation of the correction logic is shown below in Equations 1 and 2.

$$T_{accum}(k) = \sum_{i=0}^{k-1} T_{rawTarget}(i+1) - T_{out_target}(i) \quad \text{Equation 1}$$

-continued $$T_{out_target}(k) = \begin{cases} T_{rawTarget}(k), \text{ if } T_{accum}(k) \le \mu_{down} \text{ or if } T_{accum}(k) \ge \mu_{up} \\ T_{out_target}(k-1), \text{ otherwise} \end{cases} \quad \text{Equation 2}$$

The variables of Equations 1 and 2 can be defined as follows. $T_{out_target}(k)$ is the target engine outlet coolant temperature at the current time step k, $T_{rawTarget}(k)$ is a raw target engine outlet coolant temperature value derived from the aforementioned target temperature map, which is determined based on the current engine speed and torque operating conditions, and $\mu_{up}$ and $\mu_{down}$ are cooling demand thresholds whereby $\mu_{up}>0$ and $\mu_{down}<0$ for shifting the raw temperature target value $T_{rawTarget}(k)$ up or down, respectively. The index i can be set to zero when $T_{out_target}(k) \neq T_{out_target}(k-1)$. The correction logic described above can eventually work as a hysteresis function to keep the target engine outlet coolant temperature from changing too frequently.

At step 318, the control unit 110 can estimate the amount of engine heat rejection or loss ($\Delta T$) in the engine 140. The engine heat rejection ($\Delta T$) can correspond to the amount of temperature change across the engine inlet to the engine outlet. The amount of engine heat rejection ($\Delta T$) can be estimated in a variety of ways. For example, in a manner similar to the above, a pre-generated map or model can be used to estimate the engine heat rejection ($\Delta T$) based upon the one or more engine operation parameters acquired in step 314. The engine heat rejection map or model can accept the engine speed and engine torque acquired in step 314 as inputs, and produce the engine heat rejection ($\Delta T$) as output.

In steps 320 through 326, the target engine inlet coolant temperature ($T_{in_target}$) corresponding to a temperature of the coolant located at or proximate to an inlet of the engine 140 can be calculated based on the target engine outlet coolant temperature ($T_{out_target}$). In some embodiments, the target engine inlet coolant temperature ($T_{in_target}$) can be calculated by implementing a cascade feedback process including two feedback loops: a first feedback loop for calculating a virtual target engine inlet coolant temperature ("outer feedback loop"), and a second feedback loop for tracking the calculated target engine inlet coolant temperature ("inner feedback loop"). The feedback loops can utilize the current engine inlet coolant temperature ($T_{in_current}$) measured by the engine inlet temperature sensor 131 and the current engine outlet coolant temperature ($T_{out_current}$) measured by the engine outlet temperature sensor 132, as described below.

At step 320, the engine heat rejection information ($\Delta T$) estimated in step 318 can be utilized to calculate a feedforward term ($T_{FF}$), which corresponds to an anticipated temperature difference between the inlet and outlet of the engine 140, according to Equation 3 below. The feedforward term ($T_{FF}$) can be calculated for each time step k.

$$T_{FF}(k) = T_{out_target}(k) - \Delta T(k) \quad \text{Equation 3}$$

Because the engine heat rejection information ($\Delta T$) is estimated in step 318 using a pre-generated map or model, mostly at steady-state for a limited number of test points, a correction can be added based on the actual error in the engine outlet coolant temperature. To this end, at step 322, an error value ($e_{out}$) can be calculated (in the "outer feedback loop") for each time step k as the difference between the target engine outlet coolant temperature ($T_{out_target}$) and the current engine outlet coolant temperature ($T_{out_current}$) measured by the engine outlet temperature sensor 132, as shown below in Equation 4.

$$e_{out}(k)=T_{out_target}(k)-T_{out_current}(k) \quad \text{Equation 4}$$

At step 324, a feedback term ($T_{FB}$) can be calculated using Equation 5 below. The calculation of feedback term ($T_{FB}$) can be based on control unit 110 gains, $K_{P_out}$, $K_{I_out}$, and $K_{D_out}$, for the engine outlet coolant temperature, each of which can be pre-calibrated through a series of tests and/or simulations. Here, C can be the execution time step in the control unit 110. The feedback term ($T_{FB}$) can be calculated for each time step k.

$$T_{FB}(k) = K_{P_out}e_{out}(k) + K_{I_out}\sum_{j=0}^{k} e_{out}(j) + K_{D_out}\frac{e_{out}(k) - e_{out}(k-1)}{C} \quad \text{Equation 5}$$

At step 326, the target engine inlet coolant temperature ($T_{in_target}$) can be calculated by combining the feedforward term ($T_{FF}$) calculated in step 320 and the feedback term ($T_{FB}$) calculated in step 324. As shown below in Equation 6, the target engine inlet coolant temperature ($T_{in_target}$) can be calculated for each time step k.

$$T_{in_target}(k)=T_{FF}(k)+T_{FB}(k) \quad \text{Equation 6}$$

After calculating the target engine inlet coolant temperature ($T_{in_target}$) in step 326, the control unit 110 (in the "inner feedback loop") can modulate the angular position of the electric coolant valve 121 by determining the amount of movement required by the electric coolant valve 121 at each time step k (within angular speed limitations of the electric coolant valve 121). This control of the electric coolant valve 121 can enable the engine inlet coolant temperature to track the target engine inlet coolant temperature ($T_{in_target}$) obtained from the previous feedback loop.

Firstly, at step 330, another error value ($e_{in}$) can be calculated as the difference between the current engine inlet coolant temperature ($T_{in_current}$) measured by the engine inlet temperature sensor 131 in step 328 and the target engine inlet coolant temperature ($T_{in_target}$) calculated in step 326, as shown below in Equation 7.

$$e_{in}=T_{in_current}-T_{in_target} \quad \text{Equation 7}$$

Secondly, at step 332, the change in angular position ($\Delta\theta$) for the electric coolant valve 121 can be calculated for each time step k using the error value ($e_{in}$) calculated in step 330. The calculation of the change in angular position ($\Delta\theta$) can be based on control unit 110 gains, $K_{P_in}$, $K_{I_in}$, and $K_{D_in}$, for the engine inlet coolant temperature, each of which can be pre-calibrated through a series of tests and/or simulations, similar to the aforementioned control unit 110 gains for the engine outlet coolant temperature. Again, C can be the execution time step in the control unit 110, as shown below in Equation 8.

$$\Delta\theta(k) = K_{P_in}e_{in}(k) + K_{I_in}\sum_{j=0}^{k} e_{in}(j) + K_{D_in}\frac{e_{in}(k) - e_{in}(k-1)}{C} \quad \text{Equation 8}$$

At step 334, the control unit 110 can determine whether the change in angular position ($\Delta\theta$) of the electric coolant valve 121 calculated in step 332 is outside of a permissible range for each time step k. More specifically, the control unit 110 can determine whether the change in angular position ($\Delta\theta$) is greater than a predetermined upper threshold angular position change ($\Delta\theta_{max}$) (i.e., the maximum possible change in electric coolant valve angular position, referenced in step 308) or less than a predetermined lower threshold angular position change ($-\Delta\theta_{max}$) (i.e., the negative value of the maximum possible change in electric coolant valve angular position, referenced in step 312). If the change in angular position ($\Delta\theta$) is greater than the predetermined upper threshold angular position change ($\Delta\theta_{max}$), or is less than the predetermined lower threshold angular position change ($-\Delta\theta_{max}$), the procedure 300 can continue to step 336, where the control unit 110 can set the change in electric coolant valve angular position ($\Delta\theta$) according to Equation 9 below.

$$\Delta\theta(k)=\sin(\Delta\theta(k))\times\Delta\theta_{max} \quad \text{Equation 9}$$

Conversely, if the change in angular position ($\Delta\theta$) is neither greater than the predetermined upper threshold angular position change ($\Delta\theta$), nor less than the predetermined lower threshold angular position change ($-\Delta\theta_{max}$), the procedure 300 can continue to step 338, where the control unit 110 can calculate the desired angular position of the electric coolant valve 121. For instance, the desired angular position ($\theta$) of the electric coolant valve 121 can be the sum of the previous angular position ($\theta(k-1)$) of the electric coolant valve 121 and the change in angular position ($\Delta\theta$) calculated in step 332, as shown below in Equation 10. The desired angular position ($\theta$) can be calculated for each time step k.

$$\theta(k)=\theta(k-1)+\Delta\theta(k) \quad \text{Equation 10}$$

At step 340, the control unit 110 can determine whether the desired angular position ($\theta$) of the electric coolant valve 121 calculated in step 338 is outside of a permissible range. More specifically, the control unit 110 can determine whether the desired angular position ($\theta$) is greater than a predetermined maximum angular position ($\theta_{max}$) or less than a predetermined minimum angular position ($\theta_{min}$). In some embodiments, the maximum angular position ($\theta_{max}$) can correspond to a valve position where coolant fully flows through the electric coolant valve 121 to the ancillary components 150, while the minimum angular position ($\theta_{min}$) can correspond to a valve position where the coolant is entirely blocked. Outside of these positions, it is possible for the engine block side coolant path (not shown) to open incorrectly, causing split cooling to deactivate.

At step 342, the desired angular position ($\theta$) of the electric coolant valve 121 for the current time step k can be adjusted based upon whether the desired angular position ($\theta$) is outside of the aforementioned permissible range, as demonstrated below in Equation 11. If the desired angular position ($\theta$) is greater than the predetermined maximum angular position ($\theta_{max}$), the control unit 110 can adjust the desired angular position ($\theta$) to the maximum angular position ($\theta_{max}$). If the desired angular position ($\theta$) is less than the predetermined minimum angular position ($\theta_{min}$), the control unit 110 can adjust the desired angular position ($\theta$) to the minimum angular position ($\theta_{min}$). Otherwise, no adjustment of the desired angular position ($\theta$) is necessary.

$$\theta(k) = \begin{cases} \theta_{max}, \text{ if } \theta(k) > \theta_{max} \\ \theta_{min}, \text{ if } \theta(k) < \theta_{min} \\ \theta(k), \text{ otherwise} \end{cases} \quad \text{Equation 11}$$

At step 344, the control unit 110 can instruct the PW modulator 111 to generate a driving signal based on the final commanded valve angle (θ). The PW modulator 111 can transmit the generated signal to the valve actuator 120 which actuates the electric coolant valve 121, causing the electric coolant valve 121 to rotate (when necessary) to the calculated angular position (θ).

The procedure 300 illustratively ends at step 344. The techniques by which the steps of procedure 300 may be performed, as well as ancillary procedures and parameters, are described in detail above. It is to be understood the steps shown in FIG. 3 may be repeated as the engine operation parameters (e.g., engine speed, engine torque, etc.) change.

It is noted that the steps shown in FIG. 3 are merely examples for illustration, and certain other steps may be included or excluded as desired. Further, while a particular order of the steps is shown, this ordering is merely illustrative, and any suitable arrangement of the steps may be utilized without departing from the scope of the embodiments herein. Even further, the illustrated steps may be modified in any suitable manner in accordance with the scope of the present claims.

Accordingly, the methods of controlling an electric coolant valve for an internal combustion engine of a vehicle described herein can allow for accurate and responsive control for the engine TMM. The result is a series of beneficial outcomes, including improvements in fuel economy and emissions, as well as enhanced heating and cooling performance.

The foregoing description has been directed to certain embodiments of the present disclosure. It will be apparent, however, that other variations and modifications may be made to the described embodiments, with the attainment of some or all of their advantages.

Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A method comprising:

acquiring, via one or more sensors disposed in a vehicle, one or more engine operation parameters relating to operation of an internal combustion engine disposed along a coolant flow path in the vehicle;

calculating at least one target coolant temperature according to the one or more engine operation parameters;

controlling a valve actuator to regulate flow of a coolant through the coolant flow path via an electric coolant valve operatively coupled to the valve actuator such that a temperature of the coolant changes in accordance with the at least one target coolant temperature;

applying a correction value to the at least one target coolant temperature based on an accumulated cooling demand; and controlling the valve actuator to regulate flow of the coolant through the coolant flow path via the electric coolant valve operatively coupled to the valve actuator such that the temperature of the coolant changes in accordance with the at least one target coolant temperature having the correction value applied thereto.

2. The method of claim 1, wherein the controlling of the valve actuator comprises controlling the valve actuator to regulate flow of the coolant through the coolant flow path via the electric coolant valve such that a temperature of the coolant located at or proximate to an outlet of the internal combustion engine changes in accordance with the at least one target coolant temperature.

3. The method of claim 1, further comprising:

calculating a valve angular position based on the at least one target coolant temperature; and controlling the valve actuator to adjust an angular position of the electric coolant valve in accordance with the valve angular position.

4. The method of claim 3, further comprising:

generating a driving signal based on the valve angular position using a pulse-width (PW) modulator; and transmitting the driving signal to the valve actuator so as to cause the valve actuator to adjust the angular position of the electric coolant valve in accordance with the valve angular position.

5. The method of claim 1, further comprising:

acquiring an engine speed of the internal combustion engine using an engine speed sensor;

acquiring an engine torque of the internal combustion engine using an engine torque sensor; and calculating the at least one target coolant temperature according to the engine speed and the engine torque.

6. The method of claim 5, further comprising:

determining the at least one target coolant temperature using a pre-generated target temperature map configured to output the at least one target coolant temperature based on the engine speed and the engine torque.

7. The method of claim 1, wherein the calculating of the at least one target coolant temperature comprises calculating the at least one target coolant temperature for each time step of a plurality of time steps.

8. The method of claim 1, further comprising:

calculating a target engine outlet coolant temperature corresponding to a temperature of the coolant located at or proximate to an outlet of the internal combustion engine according to the one or more engine operation parameters;

calculating a target engine inlet coolant temperature corresponding to a temperature of the coolant located at or proximate to an inlet of the internal combustion engine based on the target engine outlet coolant temperature; and controlling the valve actuator to regulate flow of the coolant through the coolant flow path via the electric coolant valve such that the temperature of the coolant located at the inlet of the internal combustion engine changes in accordance with the target engine inlet coolant temperature, wherein the temperature of the coolant located at or proximate to the outlet of the internal combustion engine changes based on the temperature of the coolant located at the inlet of the internal combustion engine.

9. The method of claim 8, wherein the calculating of the target engine inlet coolant temperature comprises:

acquiring an engine speed of the internal combustion engine using an engine speed sensor;

acquiring an engine torque of the internal combustion engine using an engine torque sensor; and calculating the target engine inlet coolant temperature according to the engine speed and the engine torque.

10. The method of claim 8, wherein the calculating of the target engine inlet coolant temperature comprises calculating the target engine inlet coolant temperature based on the target engine outlet coolant temperature, a current temperature of the coolant located at or proximate to the outlet of the internal combustion engine, and a current temperature of the coolant located at or proximate to the inlet of the internal combustion engine.

11. The method of claim 10, further comprising:

acquiring the current temperature of the coolant located at or proximate to the outlet of the internal combustion engine using an engine outlet temperature sensor disposed at or proximate to the outlet of the internal combustion engine; and acquiring the current temperature of the coolant located at or proximate to the inlet of the internal combustion engine using an engine inlet temperature sensor disposed at or proximate to the inlet of the internal combustion engine.

12. The method of claim 10, further comprising:

acquiring the current temperature of the coolant located at or proximate to the outlet of the internal combustion engine using an engine outlet temperature sensor disposed at or proximate to the outlet of the internal combustion engine; and estimating the current temperature of the coolant located at or proximate to the inlet of the internal combustion engine using a predetermined model based on the current temperature of the coolant located at or proximate to the outlet of the internal combustion engine.

13. The method of claim 10, wherein the calculating of the target engine inlet coolant temperature further comprises calculating the target engine inlet coolant temperature based further on a difference between the current temperature of the coolant located at or proximate to the outlet of the internal combustion engine and the current temperature of the coolant located at or proximate to the inlet of the internal combustion engine.

14. The method of claim 8, further comprising:

calculating a valve angular position based on the target engine outlet coolant temperature and the target engine inlet coolant temperature; and controlling the valve actuator to adjust an angular position of the electric coolant valve in accordance with the valve angular position.

15. The method of claim 14, wherein the calculating of the valve angular position comprises calculating the valve angular position based on the target engine outlet coolant temperature, the target engine inlet coolant temperature, a current temperature of the coolant located at or proximate to the outlet of the internal combustion engine, and a current temperature of the coolant located at or proximate to the inlet of the internal combustion engine.

16. The method of claim 14, wherein the calculating of the valve angular position comprises calculating the valve angular position for each time step of a plurality of time steps.

17. The method of claim 1, further comprising:

calculating a change in valve angular position based on the at least one target coolant temperature;

calculating a desired valve angular position based on the change in valve angular position and a current valve angular position; and controlling the valve actuator to adjust an angular position of the electric coolant valve in accordance with the desired valve angular position.

18. The method of claim 17, wherein the calculating of the change in the valve angular position comprises calculating the change in the valve angular position based on the at least one target coolant temperature and an angular speed of the electric coolant valve.

19. The method of claim 1, wherein the valve actuator includes a rotary motor configured to adjust an angular position of an opening of the electric coolant valve.

* * * * *